US006575182B2

(12) United States Patent
Tung

(10) Patent No.: US 6,575,182 B2
(45) Date of Patent: Jun. 10, 2003

(54) TILTABLE AND ROTATABLE CANOPY FRAME FOR A SUNSHADE

(76) Inventor: Po-Lung Tung, No. 587, Chien-Gong Road, Kaohsiung (TW)

( * ) Notice: Subject to any disclaimer, the term of this patent is extended or adjusted under 35 U.S.C. 154(b) by 0 days.

(21) Appl. No.: 09/964,555

(22) Filed: Sep. 28, 2001

(65) Prior Publication Data

US 2003/0062073 A1 Apr. 3, 2003

(51) Int. Cl.[7] ..... A35B 17/00

(52) U.S. Cl. ..... 135/20.1; 135/20.3; 135/98; 248/514

(58) Field of Search ..... 135/20.1, 20.3, 135/15.1, 98, 42; 248/514

(56) References Cited

U.S. PATENT DOCUMENTS 2,721,569 A * 10/1955 Militano ..... 135/20.3
2,819,725 A * 1/1958 Borgeson ..... 135/20.3
3,175,568 A * 3/1965 Kafka ..... 135/20.3
4,582,078 A * 4/1986 Ma ..... 135/20.3
4,622,987 A * 11/1986 Redl et al. ..... 135/20.3
4,878,509 A * 11/1989 Tung ..... 135/20.3
5,029,596 A * 7/1991 Tung ..... 135/20.3
5,086,797 A * 2/1992 Earnshaw et al. ..... 135/20.1
5,711,333 A * 1/1998 Vanderminden, Sr. ..... 135/20.3
6,311,705 B1 * 11/2001 Ma ..... 135/20.3
6,446,650 B1 * 9/2002 Ma ..... 135/20.3

FOREIGN PATENT DOCUMENTS

GB 2202141 * 9/1988 ..... 135/16

* cited by examiner

*Primary Examiner*—Lanna Mai
*Assistant Examiner*—Winnie Yip
(74) *Attorney, Agent, or Firm*—Rosenberg, Klein & Lee

(57) ABSTRACT

A sunshade comprises a main post, a canopy frame, and a tilting and rotating assembly mounted between the main post and the canopy frame. Rotation of a handle on the main post in a direction causes the canopy frame to move from a folded state to an unfolded state. Further rotation of the handle in the same direction causes the canopy frame to tilt, and still further rotation of the handle in the same direction causes the tilted canopy frame to turn relative to a longitudinal axis of the main post until an optimal shield is obtained.

18 Claims, 7 Drawing Sheets

TILTABLE AND ROTATABLE CANOPY FRAME FOR A SUNSHADE

BACKGROUND OF THE INVENTION

1. Field of the Invention

The present invention relates to a tiltable and rotatable canopy frame for a sunshade.

2. Description of the Related Art

A typical sunshade comprises a main post and a canopy frame pivotally mounted to an upper end of the main post. A canopy mounted to the canopy frame can be adjusted to a tilt angle relative to the main post for optimal shield, and typical examples include U.S. Pat. No. 4,878,509 issued on Nov. 7, 1989 and U.S. Pat. No. 5,029,596 issued on Jul. 9, 1991, both to Applicant of the present application. However, it is impossible to proceed with 360° rotational adjustment of the canopy relative to the ground. Consequently, in order to obtain the best shield, the user has to manually turn the bulky and heavy base of the sunshade when the incident angle of sunlight changes. Applicant's U.S. patent application Ser. No. 09/924,705 filed on Aug. 9, 2001 discloses a tiltable and rotatable canopy frame for a sunshade, in which the canopy frame can be manually rotated to a desired angular position relative to the ground for optimal shield. Nevertheless, the operation is still inconvenient, as considerable labor is still required for manually turning the canopy frame.

SUMMARY OF THE INVENTION

An object of the present invention is to provide a tiltable and rotatable canopy frame for a sunshade to thereby allow 360° rotational adjustment of the canopy relative to the ground. Thus, difficult movement of the base of the sunshade or the canopy frame for obtaining the best shield can be avoided. In addition, rotation of the canopy relative to the ground can be easily achieved by means of operating a handle mounted to the main post of the sunshade. In a preferred embodiment, rotation of the handle in a direction causes the canopy frame to move from a folded state to an unfolded state. Further rotation of the handle in the same direction causes the canopy frame to tilt, and still further rotation of the handle in the same direction causes the tilted canopy frame to turn relative to a longitudinal axis of the main post until an optimal shield is obtained. Operation of the handle in a reverse direction returns the canopy frame to the critical position for rotation. Further rotation of the handle in this reverse rotation returns the canopy frame to an upright position, and still further rotation of the handle in this reverse direction folds the canopy frame.

Other objects, advantages, and novel features of the invention will become more apparent from the following detailed description when taken in conjunction with the accompanying drawings.

DETAILED DESCRIPTION OF THE PREFERRED EMBODIMENT

Figure 4:
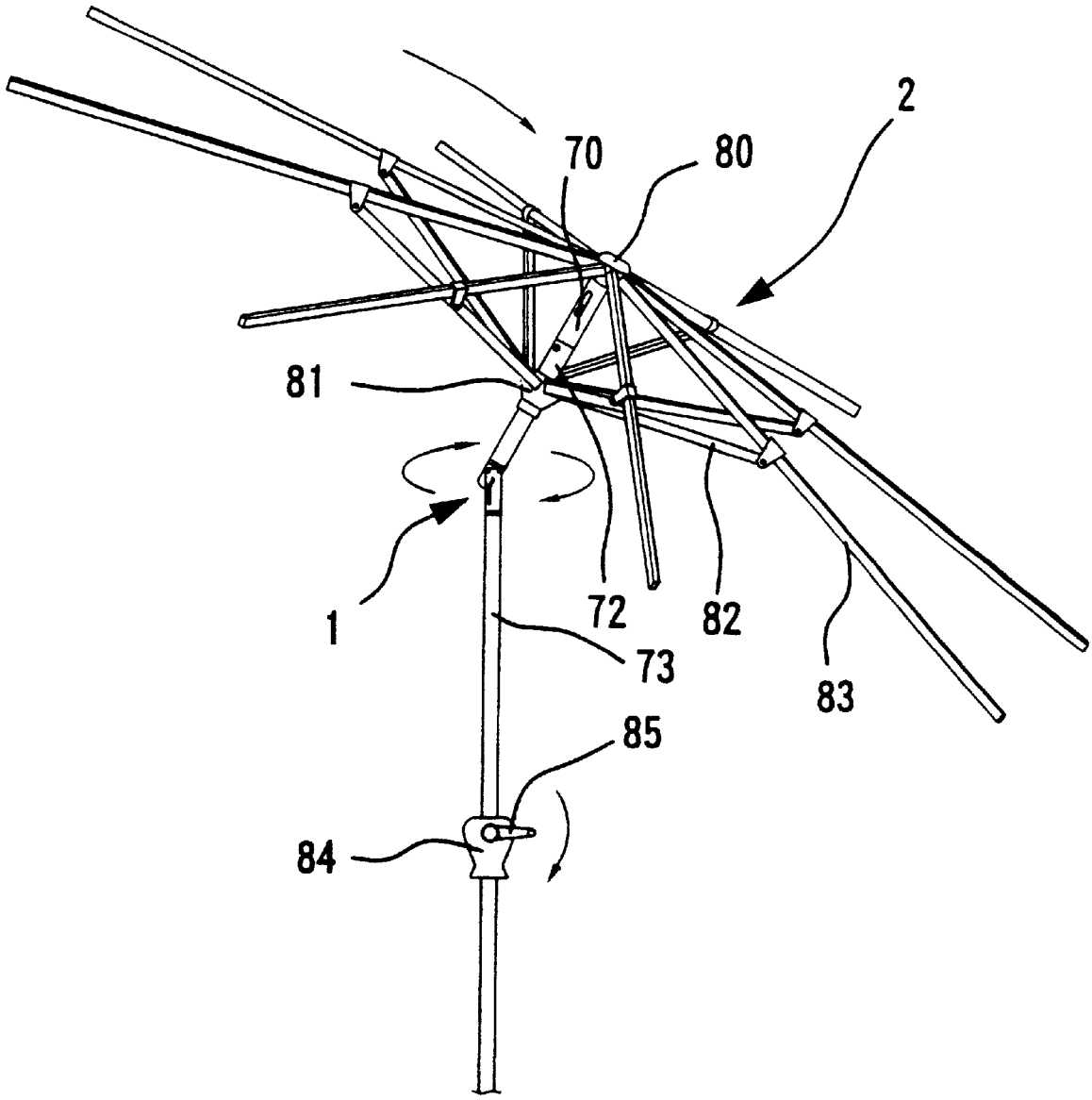
FIG. 4 is a perspective view of the sunshade having the tilting and rotating device in accordance with the present invention.

Referring to FIG. 4, a sunshade in accordance with the present invention generally includes a main post 73, a canopy frame 2, and a tilting and rotating assembly 1 mounted between an upper end of the main post 73 and a lower end of a support tube 70 of the canopy frame 2. The canopy frame 2 further comprises a runner 81 slidably mounted around the support tube 70, plural ribs 83 extending radially outward from a finishing cap 80 fixed on an upper end of the support tube 70, and plural stretchers 82. The canopy frame 2 can be adjusted to a tilt position relative to the main post 73. In addition, when reaching a maximum tilt angle, the canopy frame 2 can be rotated relative to a longitudinal axis of the main post 73 until an optimal shield is obtained, which will be described in detail later.

Figure 1:
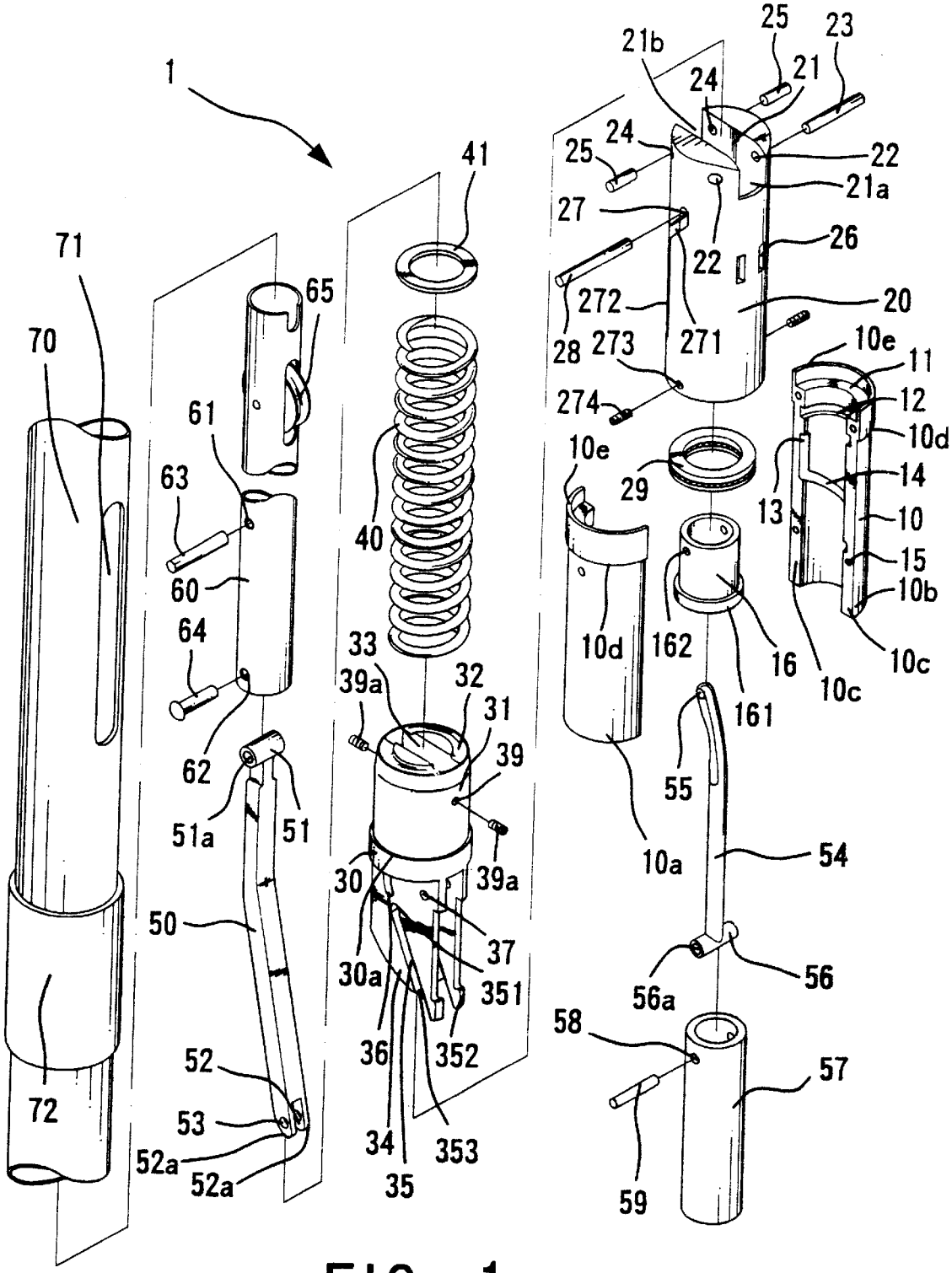
FIG. 1 is an exploded perspective view of a tilting and rotating assembly of a sunshade accordance with the present invention.
Figure 2:
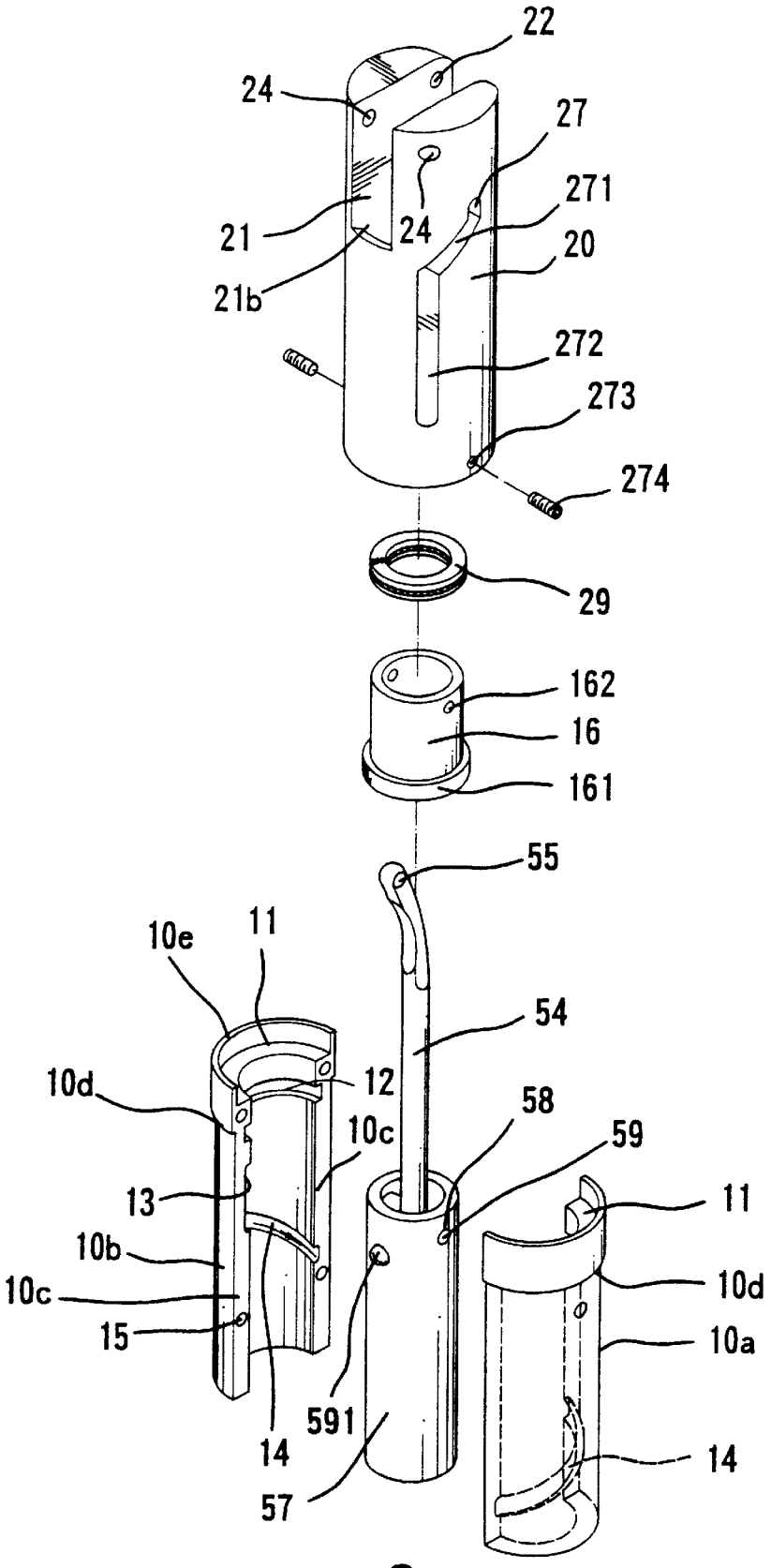
FIG. 2 is an exploded perspective view of a fixed seat, an inner sleeve, and a rotational sleeve of the tilting and rotating assembly in FIG. 1, wherein these elements are rotated through 90° from the position in FIG. 1 to show detailed structures.
Figure 3:
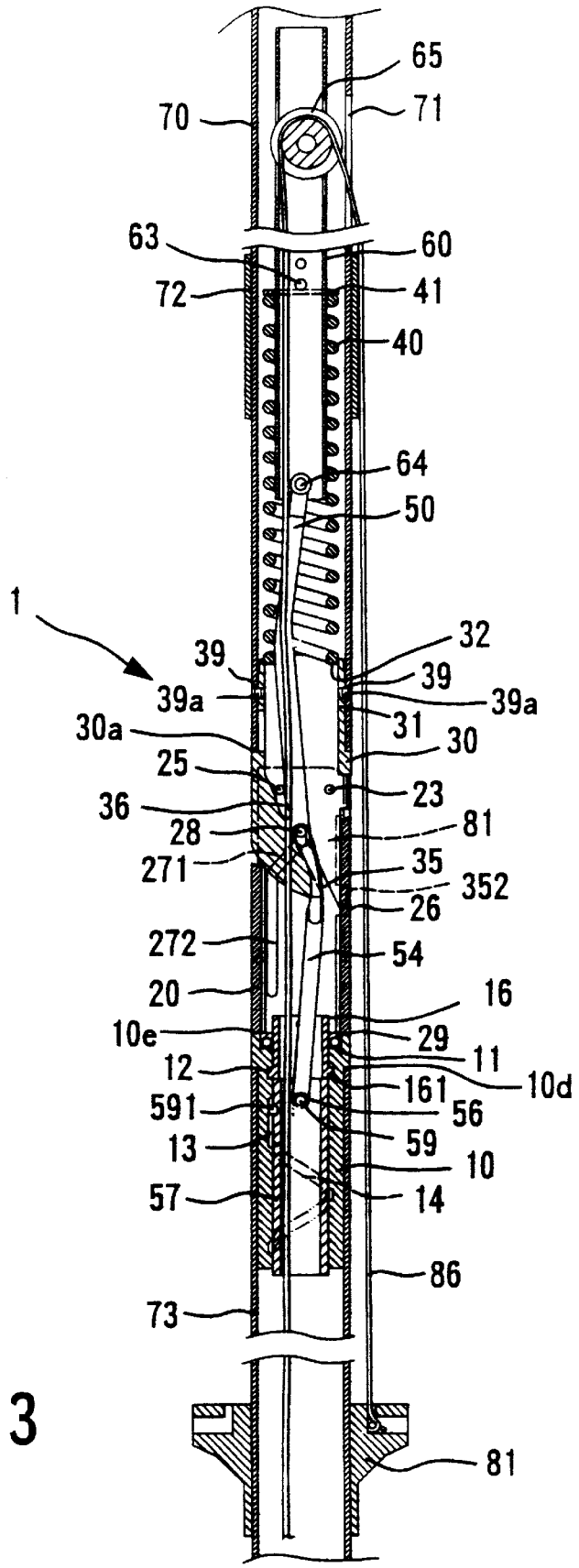
FIG. 3 is a sectional view of the tilting and rotating assembly of the sunshade in accordance with the present invention.

Referring to FIGS. 1 and 3, the tilting and rotating assembly 1 comprises a fixed seat 10, a rotational sleeve 20, a connecting tube 30, a spring 40, a first connecting rod 50, a second connecting rod 54, a rotary tube 57, and a movable tube 60. Referring to FIGS. 1 through 3, the fixed seat 10 is securely mounted in the upper end of the main post 73 by means of extending a screw (not shown) through the main post 73 and into the fixed seat 10. The fixed seat 10 comprises an annular positioning groove 11 in an upper end 11 thereof for receiving a bearing 29. An annular groove 12 is defined in an inner periphery of the fixed seat 10 and located below the annular positioning groove 11. Below the annular groove 12 is a vertical guide groove 13 defined in the inner periphery of the fixed seat 10, and a helical guide groove 14 is defined in the inner periphery of the fixed seat 10 and has an upper end communicated with a lower end of the vertical guide groove 13. The fixed seat 10 further comprises a shoulder 10*d* on an outer periphery thereof so as to abut against an end face of the upper end of the main post 73.

As illustrated in FIGS. 1 and 2, in this embodiment, the fixed seat 10 is tubular and comprised of two half casings 10*a* and 10*b* each having aligned holes 15 in two flat lateral connecting sides 10*c* thereof, and pins (not shown) are inserted into the aligned holes 15 to thereby assemble the half casings 10*a* and 10*b* together. An inner sleeve 16 is mounted in the fixed seat 10 and, extends through the bearing 29 with a flange 161 on a lower end of the inner sleeve 16 being rotatably received in the annular groove, 12 of the fixed seat 10. Thus, the inner sleeve 16 is rotatably received in the fixed seat 10. A transverse screw hole 162 is defined in the other end of the inner sleeve 16, which will be described later.

As illustrated in FIG. 3, a lower end of the rotational sleeve 20 abuts against an upper end face 10*e* of the fixed seat 10. The rotational sleeve 20 comprises a clamping groove 21 in an upper end thereof, the clamping groove 21 comprising a relatively shallower section 21*a* and a relatively deeper section 21*b*. As illustrated in FIG. 1, a transverse through-hole 22 is defined in the upper end of the rotational sleeve 20 and extends through the relatively shallower section 21*a*. Another transverse through-hole 24 is defined in the upper end of the rotational sleeve 20 and extends through the relatively deeper section 21*b*. Further, as illustrated in FIG. 2, an engaging slot 27 is defined in a periphery of the rotational sleeve 20 and has a lower end connected to an upper end of an inclined slot 271. A lower end of the inclined slot 271 is communicated with a vertical slot 272. Further, the rotational sleeve 20 further includes two transverse positioning holes 26 (FIG. 1) communicated with the clamping groove 21. A transverse screw hole 273 is defined in a lower end of the rotational sleeve 20 and aligned with the transverse screw hole 162 of the inner sleeve 16, and screws 274 are inserted into the screw holes 273 and 162 to thereby secure the rotational sleeve 20 and the inner sleeve 16 together.

Still referring to FIGS. 1 and 3, the connecting tube 30 comprises a tubular section 31 on an upper end thereof and two spaced wings 34 on a lower end thereof. A longitudinal hole 33 is defined in the tubular section 31 of the connecting tube 30. A lower end of the spring 40 is seated in an annular recessed portion 32 defined in an upper end face of the tubular section 31. Each wing 34 includes an inclined slot 35 having a downwardly facing opening 353 and an upper retaining end 351. In addition, each of the wings 34 has a protrusion 352 on a distal end thereof. The wings 34 further comprise aligned holes 37 and aligned arcuate slots 36. The wings 34 are extended into the rotational sleeve 20 via the clamping groove 21 in the upper end of the rotational sleeve 20 with the protrusions 352 respectively inserting into the positioning holes 26 of the rotational sleeve 20 and with the through-hole 22 of the rotational sleeve 20 being aligned with the holes 37 of the wings 34 and with the transverse through-hole 24 of the rotational sleeve 20 aligned with the arcuate slots 36 of the wings 34. A pin or pivot 23 extends through the transverse through-hole 22 of the rotational sleeve 20 and the holes 37 of the wings 34, thereby allowing pivotal movement of the connecting tube 30 relative to the rotational sleeve 20. A pin 25 extends through each of two separated sections of the transverse through-hole 24 of the rotational sleeve 20 and through each of the arcuate slots 36 of the wings 34, thereby guiding the pivotal movement of the connecting tube 30 relative to the rotational sleeve 20. In addition, when the pin 25 enters and is thus retained in the upper retaining ends 351 of the arcuate slots 35 of the wings 34, the connecting tube 30 and the rotational sleeve 20 may turn jointly when the handle 85 is turned, which will be described later. The connecting tube 30 is securely connected to the lower end of the support tube 70 of the canopy frame 2 to move therewith. In this embodiment, the tubular section 31 of the connecting tube 30 comprises screw holes 39, and screws 39*a* (FIG. 3) are extended through associated holes (not labeled) in the support tube 70 and the screw holes 39.

Still referring to FIGS. 1 and 3, the first connecting rod 50 comprises a connecting collar 51 in an upper end thereof and a notch 52 in a lower end thereof. In this embodiment, the lower end of the first connecting rod 50 comprises two spaced lugs 52*a*, thereby defining a space or notch 52 therebetween. Aligned holes 53 are defined in the lugs 52*a*. The movable tube 60 has a pulley 65 mounted therein. A first transverse hole 61 and a transverse second hole 62 are respectively defined in an intermediate portion and a lower end of the movable tube 60. The connecting collar 51 on the upper end of the first connecting rod 50 is located in the lower end of the movable tube 60, and a pin 64 extends through the second transverse hole 62 of the movable tube 60 and a transverse hole 51*a* of the connecting collar 51. A washer 41 is mounted around the movable tube 60 (FIG.3), and a pin 63 extends through the first transverse through-hole 61 and is located above the washer 41. Two ends of the pin 63 are located outside the movable tube 60 for retaining the washer 41. As illustrated in FIG. 3, the spring 40 is mounted around a lower portion of the movable tube 60 and an upper portion of the first connecting rod 50 with an upper end of the spring 41 being attached to the washer 41 and with the lower end of the spring 41 being positioned in the annular recessed portion 32 of the upper end of the connecting tube 30, as mentioned above. The lower end of the connecting rod 50 extends into the longitudinal hole 33 of the connecting tube 30.

Still referring to FIGS. 1 and 3, the second connecting rod 54 compromises a hole 55. in an upper end thereof and a connecting collar 56 in a lower end thereof. As illustrated in FIG. 3, the upper end of the second connecting rod 54 is located in the notch 53 of the lower end of the first connecting rod 50 that is located between the wings 34 of the connecting tube 30. A slide pin 28 extends through the engaging slot 27 of the rotational sleeve 20 and the upper retaining ends 351 of the inclined slots 35 of the wings 34 and into the holes 53 of the lugs 52*a* of the first connecting rod 50 and the hole 55 of the second connecting rod 54. Thus, the lower end of the first connecting rod 50 and the upper end of the second connecting rod 54 are pivotally connected such that the lower end of the first connecting rod 50 may pivot relative to the upper end of the second connecting rod 54 about an axis of the slide pin 28 and that the first connecting rod 50 and the second connecting rod 54 may jointly rotate about the longitudinal axis of the main post 73. The slide pin 28 is located in the inner upper retaining ends 351 of the inclined slots 35 of the wings 34 and the engaging slot 27 of the rotational sleeve 20 when the canopy frame 2 of the sunshade is in a completely folded state.

Still referring to FIGS. 1 and 3, the rotary tube 57 comprises a transverse hole 58 in an upper end thereof. The connecting collar 56 on the lower end of the second connecting rod 54 is located in the rotary tube 57, and a pin 59 extends through the transverse hole 58 of the rotary tube 57 and a transverse hole 56*a* of the connecting collar 56, thereby pivotally connecting the lower end of the second connecting rod 54 to the upper end of the rotary tube 57. Thus, the lower end of the second connecting rod 54 may pivot relative to the upper end of the rotary tube 57 about an axis of the pin 59, and the second connecting rod 54 and the rotary tube 57 may jointly rotate about the longitudinal axis of the main post 73. As illustrated in FIG. 2, a guide member 591 is provided on an outer periphery of the rotary tube 57. The rotary tube 57 is mounted in the fixed seat 10 with the guide member being received in the vertical guide groove 13 of the fixed seat 10. In this embodiment, the guide member 591 is a ball that may move along the vertical guide groove 13 and the helical guide groove 14 of the fixed seat 10 when the rotary tube 57 moves up and down, thereby guiding vertical movement and rotational movement of the rotary tube 57.

Still referring to FIGS. 1 and 3, the support tube 70 comprises a limiting flange 72 on an outer periphery thereof, and the runner 81 is slidably mounted around the support tube 70 and located below the limiting flange 72. Further, the lower end of the support tube 70 abuts against a shoulder 30*a* of the connecting tube 30. Thus, the tilting and rotating assembly 1 is mounted between the support tube 70 and the main post 73.

Referring to FIGS. 3 and 4, the support tube 70 of the canopy frame 2 further comprises a slot 71 that faces the pulley 65 in the movable tube 60. A cord 86 is wound around the pulley 65 and has an inner end extending downward through the movable tube 60, the support tube 70, the connecting tube 30, the rotational sleeve 20, the rotary tube 70, and the main post 70 and finally secured to a spool (not shown) in a winch 84 that is mounted to a lower portion of the main post 73. An outer end of the cord 86 is extended through the slot 71 of the support tube 70 and finally securely attached to the runner 81 of the canopy frame 2. The handle 85 has an inner end coupled to the spool such that rotation of the handle 85 causes outreaching movement or retraction movement of the cord 86.

The canopy frame 2 of the sunshade is in a completely folded state when the tilting and rotating assembly 1 is in a state shown in FIG. 3. When the handle 85 is rotated in a direction for retracting the cord 86, the runner 81 is moved upward to unfold the stretchers 82 and the ribs 83 until the runner 81 is stopped by the limiting flange 72 where the sunshade is in a completely unfolded state. The protrusion 352 of each wing 34 is engaged in an associated one of the positioning holes 26 of the rotational sleeve 20 when the support tube 70 of the canopy frame 2 is in an upright position relative to the main post 73.

Further rotation of the handle 85 in the same direction causes downward movement of the pulley 65 under the action of the retracting force of the cord 86. The movable tube 60 is moved downward along a longitudinal axis of the support tube 70 of the canopy frame 2 such that the pin 63 presses against the washer 41 and the spring 40 and thus compresses the spring 40. In addition, the first connecting rod 50 is also moved downward by the downwardly moving movable tube 60.

At this time, the slide pin 28 moves downward from the engaging slot 27 of the rotational sleeve 20 and the inner upper retaining ends 351 of the inclined slots 35 of the connecting tube 30 into the inclined slot 27 of the rotational sleeve 20 and the straight portions of the inclined slots 35 of the connecting tube 30. Since the inclined slot 27 of the rotational sleeve 20 and the straight portions of the inclined slots 35 of the connecting tube 30 are orientated opposite to each other and since the connecting tube 30 is pivoted to the first transverse hole 22 of the rotational sleeve 20 by the pin 23, when the cord 86 is further moved downwardly, the slide pin 28 is moved along the inclined slot 272 of the rotational sleeve 20 and presses against a wall defining each of the straight portions 35 of the connecting tube 30 such that the connecting tube 30 pivots about the pin 23 and thus moves toward the relatively shallower section 21*a* of the clamping groove 21 of the rotational sleeve 20. Namely, the canopy frame 2 is tilted, as the connecting tube 30 is secured to the support tube 70 of the canopy frame 2. The protrusion 352 of each wing 34 is disengaged from an associated one of the positioning holes 26 of the rotational sleeve 20 when the support tube 70 of the canopy frame 2 is in a tilted position relative to the main post 73.

Figure 5:
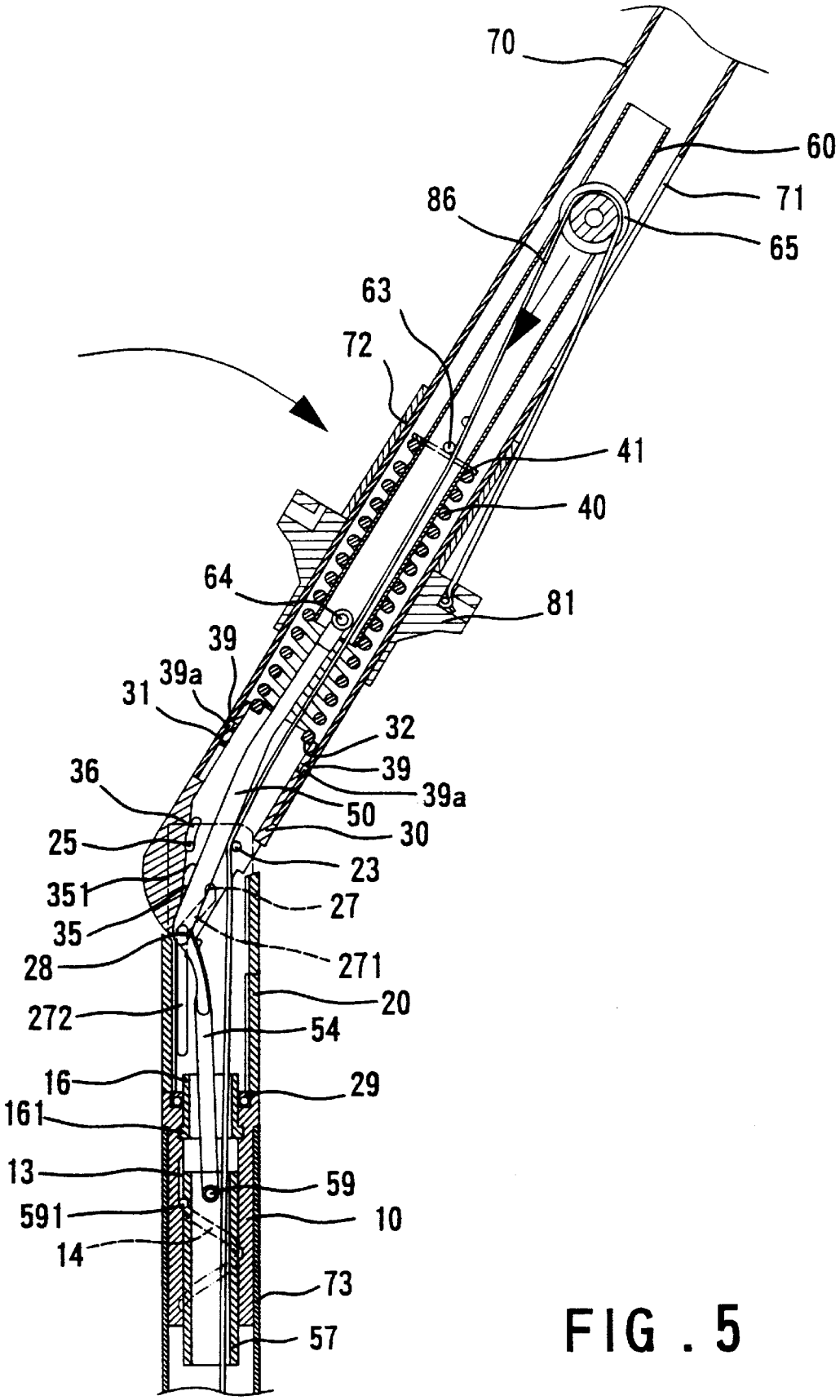
FIG. 5 is a sectional view of the tilting and rotating assembly in accordance with the present invention, wherein the tilting and rotating assembly is in a tilted state.

Referring to FIG. 5, the slide pin 28 moves downward along the inclined slot 272 of the rotational sleeve 20 and presses against the wall defining each of the straight portions 35 of the connecting tube 30 to thereby force the connecting tube 30 to pivot through an angle. Each pin 25 in the through-hole 24 of the rotational sleeve 20 reaches and is thus stopped by the lower end of the associated arcuate slot 36 in the connecting tube 30. Thus, the maximum tilt angle of the connecting tube 30 (i.e., the maximum tilt angle of the canopy frame 2) is limited. This prevents disengagement of the connecting tube 30 from the rotational sleeve 20 resulting from over-tilting of the former.

At this time, the slide pin 28 moves out of the opening 353 of each of the inclined slots 35 and the inclined slot 271 of the rotational sleeve 20 and enters the vertical guide groove 272 for downward movement, if required.

Still referring to FIG. 5, during the downward movement of the cord 86 for tilting the connecting tube 30 and the support tube 70 of the canopy frame 2 as a result of further turning the handle 85 in the same direction causes the first connecting rod 54 and the second connecting rod 54 to move downward such that the guide member 591 of the rotary tube 57 is moved downward along the vertical guide groove 13 of the fixed seat 10 to the upper end of the helical guide groove 14 of the fixed seat 10.

Figure 6:
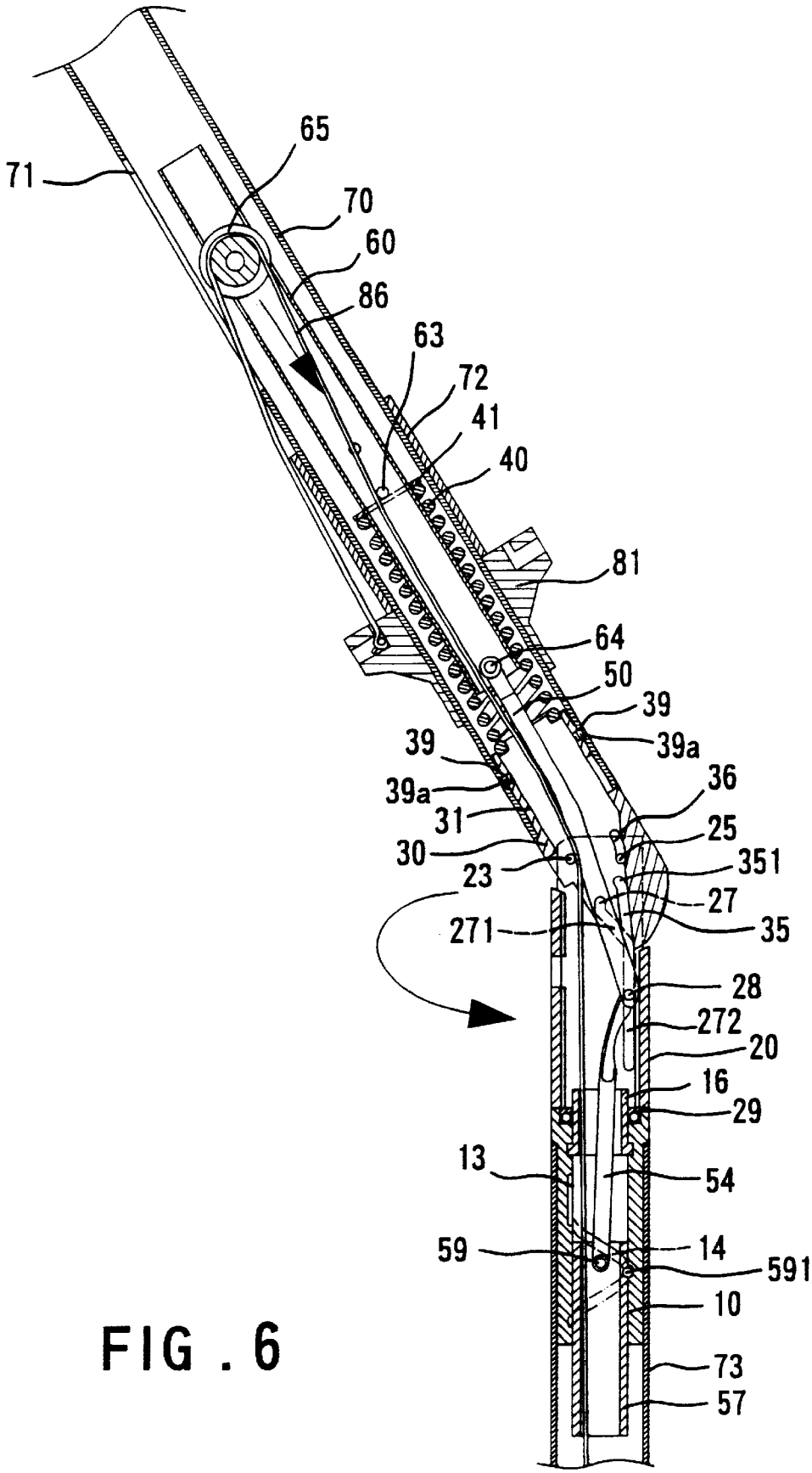
FIG. 6 is a sectional view similar to FIG. 5, wherein the tilting and rotating assembly is rotated through 180°.
Figure 7:
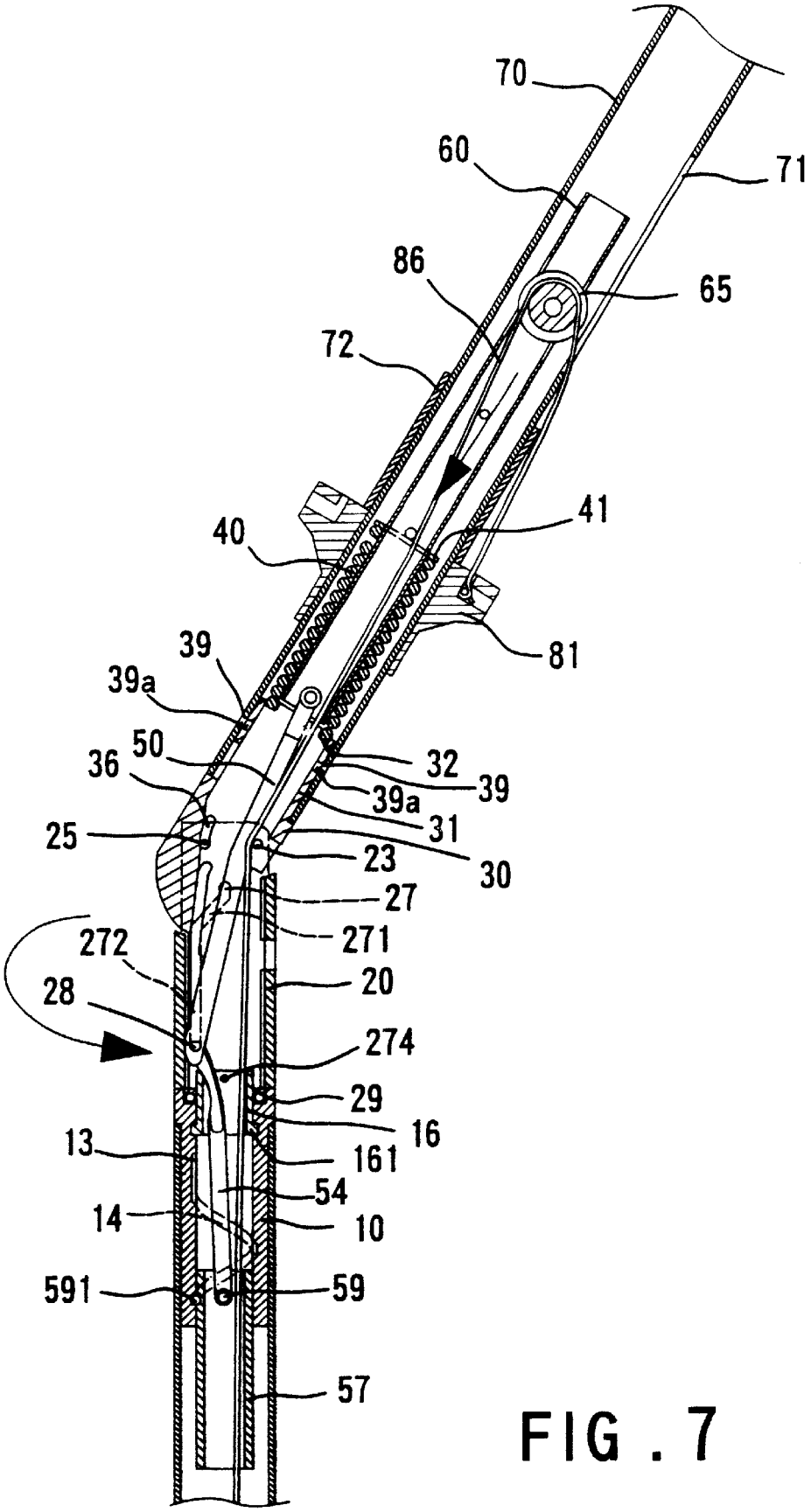
FIG. 7 is a sectional view similar to FIG. 5, wherein the tilting and rotating assembly is rotated through 360°.

Still further rotation of the handle 85 in the same direction causes the rotary tube 57 to move downward and turn, as the guide member 591 moves downward along the helical guide groove 14 of the fixed seat 10. The rotational movement of the rotary tube 57 causes the second connecting rod 54 and the first connecting rod 50 to turn. The slide pin 28 that has moved out f the inclined slots 351 of the wings 34 of the connecting tube 30 is moved downward along the vertical slot 272 of the rotational sleeve 20 and thus turns the rotational sleeve 20 and the inner sleeve 16. Thus, the inner sleeve 16, the rotational sleeve 20, and the connecting tube 30 are simultaneously turned relative to the longitudinal axis of the main post 73. The support tube 70 of the canopy frame 2 securely fixed to the tubular section 31 of the connecting tube 30 is accordingly turned relative to the longitudinal axis of the main post 73. The guide member 591 on the rotary tube 57 is firstly moved along an upper half portion of the helical guide groove 14 of the fixed seat 10. When the support tube 70 of the canopy frame 2 is turned through 180°, it is moved to a position shown in FIG. 6, and when it is further turned through another 180°, it is moved to a position shown in FIG. 7, in which the guide member 591 on the rotary tube 57 is moved along the lower half portion of the helical guide groove 14 of the fixed seat 10. Thus, 360° rotational adjustment of the canopy frame, 2 relative to the longitudinal axis of the main post 73 for optimal shield can be proceeded.

When folding the sunshade, the handle 85 is turned in a reverse direction to release the compressed spring 40, which, in turn, moves the movable tube 60 upward. The first connecting rod 50 and the second connecting rod 54 are moved upward by the movable tube 60. The rotary tube 57 moves upward while it is turned under the guidance of the guide member 591 in the helical guide groove 14 of the fixed seat 10. Thus, the rotary tube 57 is moved upward until it reaches a position shown in FIG. 5. The support tube 70 of the canopy frame 2 is turned back to the critical position for rotation. The slide pin 28 is moved upward to an upper end of the vertical slot 272 of the rotational sleeve 20.

Further rotation of the handle 85 in this reverse direction causes the slide pin 28 to enter the inclined slot 271 of the rotational sleeve 20 and the straight portions of the inclined slots 35 of the connecting tube 30. The connecting tube 30 together with the support tube 70 of the canopy frame 2 is gradually moved back to the upright position where the slide pin 28 enters and is thus retained in the engaging slot 27 of the rotational sleeve 20 and the upper retaining ends 351 of the inclined slots 35 of the connecting tube 30. Still further rotation of the handle 85 in this reverse direction causes downward movement of the runner 81 under the action of the weight of the stretchers 82 and the ribs 83. The canopy frame 2 is thus folded.

According to the above description, it is appreciated that the canopy frame 2 can be tilted to a desired tilt angle. In addition, 360° rotational adjustment of the canopy frame 2 relative to the longitudinal axis of the main post 73 for optimal shield can be proceeded by means of using the tilting and rotating device 1 in accordance with the present invention, which can be easily achieved by means of simply operating the handle 85 without any difficulty. Operation of the handle 85 in a reverse direction returns the canopy frame 2 to the critical position for rotation. Further rotation of the handle 85 in this reverse rotation returns the canopy frame 2 to an upright position, and still further rotation of the handle 85 in this reverse direction folds the canopy frame 2.

Although the invention has been explained in relation to its preferred embodiment, it is to be understood that many other possible modifications and variations can be made without departing from the scope of the invention as hereinafter claimed.

What is claimed is:

1. A sunshade comprising:

a main post (73), a handle (85) being mounted to the main post;

a canopy frame (2); and a tilting and rotating assembly (1) mounted between the main post and the canopy frame;

the handle (85), the canopy frame (2), and the tilting and rotating assembly (1) being so arranged that rotation of the handle (85) on the main post in a direction causes the canopy frame (2) to move from a folded state to an unfolded state, that further rotation of the handle (85) in the direction causes the canopy frame (2) to tilt relative to the main post (73), and that still further rotation of the handle (85) in the same direction causes the tilted canopy frame (2) to turn relative to a longitudinal axis of the main post (70);

the canopy frame (2) comprising a support tube (70) and a runner (81) slidably mounted around the support tube (70), the support tube (70) having a slot (71), the tilting and rotating assembly (1) comprising:

a fixed seat (10) securely mounted in the main post (73), the fixed seat comprising a vertical guide groove (13) defined in an inner periphery thereof and a helical guide groove (14) defined in the inner periphery, the helical guide groove having an upper end communicated with a lower end of the vertical guide groove;

a rotational sleeve (20) mounted to an upper end of the fixed seat (10), the rotational sleeve being rotatable relative to the fixed seat (10) and comprising an upper end, the rotational sleeve further comprising an engaging slot (27), an inclined slot (271) having an upper end communicated with the engaging slot (27) and a lower end, and a vertical slot (272) having an upper end communicated with the lower end of the inclined slot (271);

a connecting tube (30) comprising an upper end secured to the support tube (70) to move therewith, the connecting tube (30) including two spaced wings (34) formed on a lower end thereof, a pin (23) extending through the wings (34) of the connecting tube (30) and the upper end of the rotational sleeve (20) to thereby allow pivotal movement of the connecting tube (30) relative to the rotational sleeve (20), each of the wings comprising an inclined slot (35) having an upper retaining end (351);

a first connecting rod (50) comprising an upper end and a lower end, the lower end of the first connecting rod (50) extending through the upper end of the connecting tube (30) with the lower end of the first connecting rod (50) being located between the wings (34) of the connecting tube (30);

a movable tube (60) mounted in the support tube (70) of the canopy frame (2) and slidable along a longitudinal axis of the support tube (70), the movable tube (60) including a lower end to which the upper end of the first connecting rod (50) is pivotally connected, a pulley (65) being mounted in the movable tube (60) and facing the slot (71) of the support tube (70) of the canopy frame (2);

a spring (40) comprising a lower end attached to the upper end of the connecting tube (30) and an upper end attached to the movable tube (60);

a second connecting rod (54) comprising an upper end pivotally connected to the lower end of the first connecting rod (50) by a slide pin (28) that extends through the engaging slot (27) of the rotational sleeve (20) and the upper retaining ends (351) of the inclined slots (35) of the wings (34), the second connecting rod (54) further comprising a lower end;

a rotary tube (57) mounted in the fixed seat (10), the lower end of the second connecting rod (54) being pivotally connected to the rotary tube (57), the rotary tube (57) comprising a guide member (591) on an outer periphery thereof, the guide member (591) being movably guided in the vertical guide groove (13) and the helical guide groove (14) of the fixed seat (10); and a cord (86) mounted around the pulley (65) in the movable tube (60) and comprising an inner end operably connected to the handle (85) and an outer end securely attached to the runner (81) to move therewith, rotational movement of the handle (85) in the direction causing retraction movement of the cord (86) and rotational movement of the handle (85) in said reverse direction causing outreaching movement of the cord (86) to thereby control movement of the runner (81) along the support tube (70) of the canopy frame (2) and to thereby control a position of the support tube (70) relative to the main post (73);

wherein when the canopy frame (2) is in a completely folded state, the slide pin (28) is located in the engaging slot (27) of the rotational sleeve (20) and the upper retaining ends (351) of the inclined slots (35) of the wings (34);

wherein when the canopy frame (2) is tilting relative to the main post (73), the slide pin (28) slides along the inclined slot (271) of the rotational sleeve (20) and the inclined slots (35) of the wings (34), while the guide member (591) on the rotary tube (57) slides along the vertical guide groove (13) of the fixed seat (10); and wherein when the canopy frame (2) is rotating relative to the main post (73), the slide pin (28) is disengaged from the inclined slots (35) of the wings (34) of the connecting tube (30) and slides along the vertical slot (272) of the rotational sleeve (20), while the guide member (591) on the rotary tube (57) slides along the helical guide groove (13) of the fixed seat (10).

2. The sunshade as claimed in claim 1, wherein the fixed seat (10) comprises two half casings (10*a* and 10*b*).

3. The sunshade as claimed in claim 1, wherein the fixed seat (10) comprises a shoulder (10*d*) on an outer periphery thereof, the shoulder abutting against an upper end face of the main post (73).

4. The sunshade as claimed in claim 1, wherein the fixed seat (10) comprises an annular groove (12) in the inner periphery thereof, further comprising an inner sleeve (16) mounted in the main post (73), the inner sleeve comprising a flange (161) on a lower end thereof, the flange of the inner sleeve being rotatably received in the annular groove (12) of the fixed seat (10), wherein when the canopy frame (2) is in the completely folded state, an upper end of the rotary tube (57) is in contact with an end face of the lower end of the inner sleeve (16) to thereby prevent excessive upward movement of the rotary sleeve (57).

5. The sunshade as claimed in claim 4, wherein the fixed seat (10) comprises a bearing (29) mounted in an upper end thereof for supporting an upper end of inner sleeve (16).

6. The sunshade as claimed in claim 1, wherein the wings (34) of the connecting tube (30) comprises aligned holes (37), the upper end of the rotational sleeve (20) comprising a clamping groove (21) having a relatively shallower section (21*a*) and a relatively deeper section (21*b*), a first transverse through-hole (22) being defined in the upper end of the rotational sleeve (20) and extending through the relatively shallower section (21*a*), the pin (23) extending through the first transverse through-hole (22) of the rotational sleeve (20) and the holes (37) of the wings (34) of the connecting tube (30), thereby allowing pivotal movement of the connecting tube (30) relative to the rotational sleeve (20) when tilting the canopy frame (2) relative to the main post (73).

7. The sunshade as claimed in claim 6, wherein the wings (34) of the connecting tube (30) comprise aligned arcuate slots (36), a second transverse through-hole (24) being defined in the upper end of the rotational sleeve and extending through the relatively deeper section (21*b*) and thus having two separated sections spaced by the clamping groove (21), a further pin (25) being extended through an associated one of the separated sections of the second transverse through-hole (24) and an associated one of the aligned arcuate slots (36) to thereby guide the pivotal movement of the connecting tube (30) relative to the rotational sleeve (20).

8. The sunshade as claimed in claim 1, wherein the movable tube (60) comprises a transverse hole (61) in an intermediate portion thereof, a pin (63) extending through the transverse hole (61) with two ends of the pin (63) outside the movable tube (60), a washer (41) being mounted around the movable tube (60) and located below the pin (63), the upper end of the spring (40) being attached to the washer (41).

9. The sunshade as claimed in claim 8, wherein the upper end of the connecting tube (30) comprises an annular recessed portion (32) for receiving the lower end of the spring (40).

10. The sunshade as claimed in claim 1, wherein the support tube (70) comprises a limit flange (72) on an outer periphery thereof for preventing further upward movement of the runner (85) when the canopy frame (2) is in the completely folded state.

11. The sunshade as claimed in claim 1, wherein the rotational sleeve (20) further comprises two positioning holes (26), each of the wings (34) having a protrusion (352) that is releasably engaged in an associated one of the positioning holes (26) of the rotational sleeve (20) when the support tube (70) of the canopy frame (2) is in an upright position relative to the main post (73).

12. A sunshade comprising:

a main post (73), a handle (85) being mounted to the main post;

a canopy frame (2); and a tilting and rotating assembly (1) mounted between the main post and the canopy frame;

the handle (85), the canopy frame (2), and the tilting and rotating assembly (1) being so arranged that rotation of the handle (85) on the main post in a direction causes the canopy frame (2) to move from a folded state to an unfolded state, that further rotation of the handle (85) in the direction causes the canopy frame (2) to tilt relative to the main post (73), and that still further rotation of the handle (85) in the same direction causes the tilted canopy frame (2) to turn relative to a longitudinal axis of the main post (70);

wherein rotation of the handle (85) in a reverse direction causes the tilted and rotated canopy frame (2) to a critical position for rotation, further rotation of the handle (85) in said reverse rotation returning the canopy frame (2) to an upright position relative to the main post (73), and still further rotation of the handle (85) in said reverse direction folding the canopy frame (2);

wherein the canopy frame (2) comprises a support tube (70) and a runner (81) slidably mounted around the support tube (70), the support tube (70) having a slot (71), the tilting and rotating assembly (1) comprising:

a fixed seat (10) securely mounted in the main post (73), the fixed seat comprising a vertical guide groove (13) defined in an inner periphery thereof and a helical guide groove (14) defined in the inner periphery, the helical guide groove having an upper end communicated with a lower end of the vertical guide groove;

a rotational sleeve (20) mounted to an upper end of the fixed seat (10), the rotational sleeve being rotatable relative to the fixed seat (10) and comprising an upper end, the rotational sleeve further comprising an engaging slot (27), an inclined slot (271) having an upper end communicated with the engaging slot (27) and a lower end, and a vertical slot (272) having an upper end communicated with the lower end of the inclined slot (271);

a connecting tube (30) comprising an upper end secured to the support tube (70) to move therewith, the connecting tube (30) including two spaced wings (34) formed on a lower end thereof, a pin (23) extending through the wings (34) of the connecting tube (30) and the upper end of the rotational sleeve (20) to thereby allow pivotal movement of the connecting tube (30) relative to the rotational sleeve (20), each of the wings comprising an inclined slot (35) having an upper retaining end (351);

a first connecting rod (50) comprising an upper end and a lower end, the lower end of the first connecting rod (50) extending through the upper end of the connecting tube (30) with the lower end of the first connecting rod (50) being located between the wings (34) of the connecting tube (30);

a movable tube (60) mounted in the support tube (70) of the canopy frame (2) and slidable along a longitudinal axis of the support tube (70), the movable tube (60) including a lower end to which the upper end of the first connecting rod (50) is pivotally connected, a pulley (65) being mounted in the movable tube (60) and facing the slot (71) of the support tube (70) of the canopy frame (2);

a spring (40) comprising a lower end attached to the upper end of the connecting tube (30) and an upper end attached to the movable tube (60);

a second connecting rod (54) comprising an upper end pivotally connected to the lower end of the first connecting rod (50) by a slide pin (28) that extends through the engaging slot (27) of the rotational sleeve (20) and the upper retaining ends (351) of the inclined slots (35) of the wings (34), the second connecting rod (54) further comprising a lower end;

a rotary tube (57) mounted in the fixed seat (10), the lower end of the second connecting rod (54) being pivotally connected to the rotary tube (57), the rotary tube (57) comprising a guide member (591) on an outer periphery thereof, the guide member (591) being movably guided in the vertical guide groove (13) and the helical guide groove (14) of the fixed seat (10); and a cord (86) mounted around the pulley (65) in the movable tube (60) and comprising an inner end operably connected to the handle (85) and an outer end securely attached to the runner (81) to move therewith, rotational movement of the handle (85) in the direction causing retraction movement of the cord (86) and rotational movement of the handle (85) in said reverse direction causing outreaching movement of the cord (86) to thereby control movement of the runner (81) along the support tube (70) of the canopy frame (2) and to thereby control a position of the support tube (70) relative to the main post (73);

wherein when the canopy frame (2) is in a completely folded state, the slide pin (28) is located in the engaging slot (27) of the rotational sleeve (20) and the upper retaining ends (351) of the inclined slots (35) of the wings (34);

wherein when the canopy frame (2) is tilting relative to the main post (73), the slide pin (28) slides along the inclined slot (271) of the rotational sleeve (20) and the inclined slots (35) of the wings (34), while the guide member (591) on the rotary tube (57) slides along the vertical guide groove (13) of the fixed seat (10); and wherein when the canopy frame (2) is rotating relative to the main post (73), the slide pin (28) is disengaged from the inclined slots (35) of the wings (34) of the connecting tube (30) and slides along the vertical slot (272) of the rotational sleeve (20), while the guide member (591) on the rotary tube (57) slides along the helical guide groove (13) of the fixed seat (10).

13. The sunshade as claimed in claim 12, wherein the fixed seat (10) comprises two half casings (10*a* and 10*b*).

14. The sunshade as claimed in claim 12, wherein the fixed seat (10) comprises a shoulder (10*d*) on an outer periphery thereof, the shoulder abutting against an upper end face of the main post (73).

15. The sunshade as claimed in claim 12, wherein the fixed seat (10) comprises an annular groove (12) in the inner periphery thereof, further comprising an inner sleeve (16) mounted in the main post (73), the inner sleeve comprising a flange (161) on a lower end thereof, the flange of the inner sleeve being rotatably received in the annular groove (12) of the fixed seat (10), wherein when the canopy frame (2) is in the completely folded state, an upper end of the rotary tube (57) is in contact with an end face of the lower end of the inner sleeve (16) to thereby prevent excessive upward movement of the rotary sleeve (57).

16. The sunshade as claimed in claim 15, wherein the fixed seat (10) comprises a bearing (29) mounted in an upper end thereof for supporting an upper end of inner sleeve (16).

17. The sunshade as claimed in claim 12, wherein the wings (34) of the connecting tube (30) comprises aligned holes (37), the upper end of the rotational sleeve (20) comprising a clamping groove (21) having a relatively shallower section (21*a*) and a relatively deeper section (21*b*), a first transverse through-hole (22) being defined in the upper end of the rotational sleeve (20) and extending through the relatively shallower section (21*a*), the pin (23) extending through the first transverse through-hole (22) of the rotational sleeve (20) and the holes (37) of the wings (34) of the connecting tube (30), thereby allowing pivotal movement of the connecting tube (30) relative to the rotational sleeve (20) when tilting the canopy frame (2) relative to the main post (73).

18. The sunshade as claimed in claim 17, wherein the wings (34) of the connecting tube (30) comprise aligned arcuate slots (36), a second transverse through-hole (24) being defined in the upper end of the rotational sleeve and extending through the relatively deeper section (21*b*) and thus having two separated sections spaced by the clamping groove (21), a further pin (25) being extended through an associated one of the separated sections of the second transverse through-hole (24) and an associated one of the aligned arcuate slots (36) to thereby guide the pivotal movement of the connecting tube (30) relative to the rotational sleeve (20).

* * * * *